United States Patent [19]

Nieman

[11] Patent Number: 4,643,417

[45] Date of Patent: Feb. 17, 1987

[54] HAND MANIPULATED EXERCISE DEVICE

[76] Inventor: Frank C. Nieman, P.O. Box 785, Libertyville, Ill. 60048

[21] Appl. No.: 542,888

[22] Filed: Oct. 17, 1983

[51] Int. Cl.[4] ..... A63B 5/00; A63B 11/08

[52] U.S. Cl. ..... 272/67; 272/131

[58] Field of Search ..... 272/67, 68, 132, 131, 272/140, DIG. 4, DIG. 5, 141; 273/DIG. 4

[56] References Cited

U.S. PATENT DOCUMENTS

| | | | |
|---|---|---|---|
| 2,106,994 | 2/1938 | Chapman | 272/141 |
| 3,184,234 | 5/1965 | Struble | 272/131 |
| 3,211,453 | 10/1965 | Williams | 272/68 |
| 3,717,338 | 2/1973 | Hughes | 272/132 |
| 3,764,131 | 10/1973 | Rooks | 272/67 |
| 3,830,493 | 8/1974 | Miller | 272/132 |
| 3,957,266 | 5/1976 | Rice | 273/DIG. 4 |

*Primary Examiner*—Apley Richard J.
*Assistant Examiner*—S. R. Crow
*Attorney, Agent, or Firm*—Thomas R. Vigil

[57] ABSTRACT

The hand manipulated exercise device comprises first and second hollow tubes which have hand grippable outer surfaces. The second hollow tube is telescopically received in the first hollow tube and the tubes are held together by a coupling mechanism. The coupling mechanism permits relative rotation of the two hollow tubes against two axially facing frictional surfaces within the tubes. The coupling mechanism includes a pressure applying mechanism situated within the first tube, which urges the axially facing frictional surfaces toward each other. The pressure applying mechanism rotates with the first hollow tube to minimize wear on components of the pressure applying mechanism. A special indicating wrench is also provided which is received over a nut of the pressure applying mechanism in the first tube for adjusting the amount of pressure exerted on the frictional surfaces and for indicating the amount of pressure being applied.

18 Claims, 10 Drawing Figures

HAND MANIPULATED EXERCISE DEVICE

BACKGROUND OF THE INVENTION

1. Field of the Invention

The present invention relates to hand manipulated exercise devices and more particularly, to a device including opposed tubes, one telescopically received in the other, which are rotatable in opposite directions with the rotation being frictionally resisted in an axial direction by means of pressure on opposite sides of a rubber washer in the tubes. The degree of frictional resistance to rotation is adjustable utilizing a special indicator wrench.

2. Description of the Prior Art

Heretofore, various hand manipulatable exercise devices have been proposed. Examples of such previously proposed devices are disclosed in the following patents:

| U.S. PAT. NO. | PATENTEE |
|---|---|
| 3,184,234 | Struble |
| 3,211,453 | Williams |
| 3,666,267 | McKinney |
| 3,717,338 | Hughes |
| 3,764,131 | Rooks |
| 3,830,493 | Miller |
| 4,095,789 | Mueller |
| 4,155,547 | Savio et al |
| 4,171,802 | Stoecker |

The Struble U.S. Pat. No. 3,184,234 discloses an exercise device for use in developing the muscles of the hands, wrist and arms. The invention comprises a pair of generally cylindrical hollow gripping elements rotatably mounted in end to end relation on a rod. Disc-like friction members are situated adjacent axial end faces of the gripping members and a retainer member in the form of a knob is mounted on each terminal end of the rod. At least one of the knobs is adapted for movement axially on the rod whereby the pressure applying relation between the gripping elements and the friction member may be varied selectively, thereby to vary the resistance to relative turning of the gripping elements to suit the exercise requirements of the user.

The Williams U.S. Pat. No. 3,211,453 discloses a hand, wrist and arm exerciser embodying a pair of companion end-to-end axially aligned hand grips. One grip is provided for each hand, and each grip being appropriately shaped and contoured for retention in the hand. These two grips are coupled in axial alignment, each have a tubular casing with contiguous inner ends being plugged and the plugs being disposed in abutting relationship and relatively movable one in relation to the other by turning of the hand grips in opposite rotatable directions. A brake assembly is positioned in one hand grip while the other hand grip is provided at an outer end with a finger turn knob, the knob serving to actuate a brake operating rod and the rod being arranged with one end portion connected to the brake assembly, and the other end portion adjustably and operatively connected to the knob.

The McKinney U.S. Pat. No. 3,666,267 discloses an exercising device for the hands, wrist and forearm including an elongate bar having an enlarged flange integral with one end thereof. An enlarged rotatable member is carried at right angles to the bar in frictional contact with the flange. A friction producing member is carried between the flange and the rotatable member and forces exerted by the hands with respect to the rotatable member are resisted by the engagement thereof with the friction producing member. A spring is provided with a compression adjustable mechanism for varying the frictional contact force between the flange and the rotatable member.

The Hughes U.S. Pat. No. 3,717,338 discloses a wrist exercising device comprising two hand grip units provided with adjacent friction surfaces compressed together by a spring. The pressure exerted thereby is adjustable by a threaded rod screwed in one of the units to which the spring is connected. The spring is also connected to an adjusting knob on the other unit whereby spring tension is adjusted by turning the knob to move the rod.

The Rooks U.S. Pat. No. 3,764,131 discloses a wrist exerciser comprising a pair of slightly conical, hollow, and substantially identical, hand grips which are sleeved at their adjacent ends snuggly upon the opposite ends of a connecting member for relative rotation. Nut and bolt members extend lengthwise within the grips and engage transverse wall sections within the grips for adjusting the frictional engagement of the grips with the connecting member. Additional larger and hollow hand grips can be mounted upon the smaller hand grips to increase the diameter of the manually grippable surfaces.

The Miller U.S. Pat. No. 3,830,493 discloses a hand and wrist exercising device including a pair of generally cylindrical hand grippable elements coaxially mounted for relative rotation and having opposite radial end faces with an annular rubber disc disposed between and engaging the opposite radial end faces to resist relative rotation between the elements. One of the elements has an axial bore and a shaft extends through the bore and has one end fixed to the other element and a cap threaded on the other end. A helical compression spring is mounted around the shaft within the bore and acts between a shoulder in the bore and the cap through a thrust bearing so that the spring exerts a force biasing the hand grippable elements toward one another against the rubber disc. The amount of friction is varied by turning the cap on the shaft to adjust the spring compression and thereby the biasing force.

The Mueller U.S, Pat. No. 4,095,789 discloses a torsional twist, wrist exercising device including a pair of hand grips disposed in contiguous end-to-end relation on a common central longitudinal axis. The grips are operatively interconnected with each other so as to maintain their contiguous relation while permitting rotative movements thereof relative to each other about their common axis. A central longitudinally extending shaft is affixed at one end to one of the grips and a central longitudinal bore is formed within the other grip for coaxially receiving the shaft. At least one torsion spring is supported upon the shaft and spring retaining members are provided for detachably securing one end of the spring to the shaft and the other end of the spring to the wall defining the interior surface of the bore. A cap member is provided for maintaining contiguous end-to-end relation of the grips during exercising use.

The Savio et al U.S. Pat. No. 4,155,547 discloses a torsion spring type wrist exercising device comprising a pair of longitudinally aligned tubular members movable axially relative to each other, such movement being resisted by an adjustable spring force. A spring system has a variable length to adjust the tension and the torsion of the spring system. One of the tubular members is preferably formed of a clear material in order that the adjustment can be visually observed.

The Stoecker U.S. Pat. No. 4,171,802 discloses a hydraulic torque reaction wrist and arm exerciser employing rotary motion and including a resistance torque device with first and second relatively rotatable units mounting hand grips. The units are spaced substantially equa-distance between the hand grips. Resistance torque is developed within the device upon rotating the hand grips. The amount of torque is determined by the restriction of flow of hydraulic fluids between compartments of an annular chamber increasing in proportion to the turning effort applied to the device and being adjustable by an externally operable valve mechanism for changing the size of the flow restriction, one of the units having a mechanism for restricting fluid movement therefrom.

As will be described in greater detail hereinafter, the hand manipulated exercise device of the present invention differs from the devices previously proposed by being simpler to manufacture and assemble than prior exercising devices and by providing for fixing of a spring tension assembly within one tube of the device such that the spring of the assembly rotates with the tube when the tube is rotated thereby eliminating wear on the surfaces of washers against which ends of the spring bear.

The device of the present invention further includes a special indicator wrench for adjusting the degree of frictional resistance to rotation between the opposed handles of the device and for indicating the amount of frictional resistance being employed.

SUMMARY OF THE INVENTION

According to the invention, there is provided a hand manipulatable exercise device comprising first and second hollow tubes each having a hand grippable outer surface, said second tube being telescopically received in said first tube, and means within said tubes for coupling said tubes together in a manner permitting relative rotation therebetween against an adjustable frictional resistance to rotation thereof, said coupling means including means for establishing at least two frictional surface, means located within and rotatable with said first tube for adjusting pressure on said surfaces, said coupling means including a first plug member fixed within said first tube, a second plug member fixed to the inner end of said second tube, means for urging said plug members toward each other including a shaft, said first plug member further having a bore therethrough having a splined cross-section, and said shaft having a spline formation on at least a middle portion thereof arranged to be received within said spline cross-section bore whereby said shaft is slidable in said spline cross-section bore and rotates with said first tube.

DESCRIPTION OF THE PREFERRED EMBODIMENTS

Figure 1:
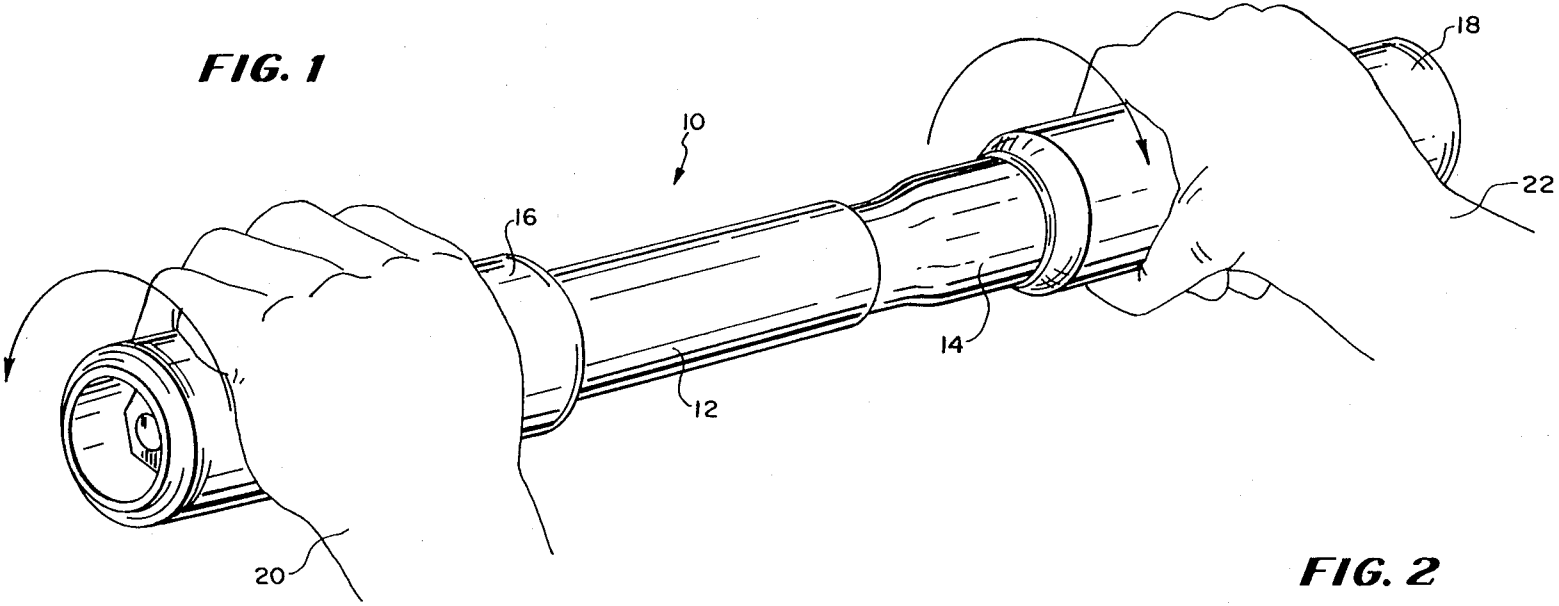
FIG. 1 is a perspective view of the exercising device of the present invention.

Referring now to the drawings in greater detail, there is illustrated in FIG. 1 a hand manipulated exercise device 10 constructed in accordance with the teachings of the present invention. The device 10 includes first and second tubes 12 and 14, with the second tube 14 telescopically received in the first tube 12. Gripping surfaces 16 and 18 are provided on the tubes to enable a user to grip the device 10 with both hands 20 and 22 and rotate the tubes 12 and 14 relative to each other against a frictional resistance force.

Figure 2:
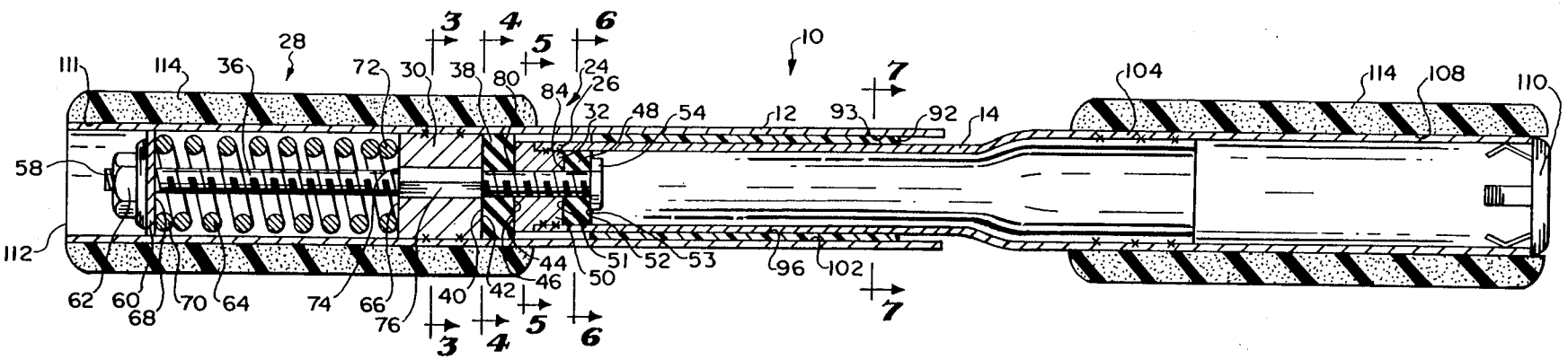
FIG. 2 is a sectional view of the exercising device shown in FIG. 1.

As better illustrated in FIG. 2, the first tube 12 telescopically receives the second tube 14 and the tubes 12 and 14 together have mounted therein a coupling assembly 24 which is situated in the first tube and an inner end portion 26 of the second tube 14. The coupling assembly 24 urges tubes 12 and 14 together and includes a pressure applying assembly 28 situated in the first tube 12.

The coupling assembly 24 includes a first plug member 30 permanently affixed, such as by spot welds, within and to the first tube 12, a second plug member 32 permanently affixed, such as by spot welds, to the inner end portion 26 of the second tube 14, and a shaft 36 extends through the first and second plug members 30 and 32.

An elastomeric washer 38 is positioned on the shaft 36 between plug members 30 and 32 to establish two pairs of frictional surfaces 40, 42 and 44, 46 between each side surface 40 and 46 of the washer 38 and the adjacent face 42 or 44 of respective plug member 30 or 32.

The inner end of the shaft 36 within the second tube 14 has an elastomeric washer 48 therein between a head 54 of the shaft 36 and one side of the plug member 32.

This positioning of the washer 48 establishes two additional pairs of frictional surfaces 50, 51 and 52, 53 between each side surface 51 and 53 of the washer 48 and, on one side, an adjacent face 50 of the second plug member 32, and on the other side, an adjacent face 53 of the head 54 of shaft 36.

Further, the washer 48 acts as a brake shoe against the shaft head 54 and the surface 50 of plug 32 and has a relatively high coefficient of friction to create resistance to rotation under pressure applied by the pressure applying assembly 28.

The pressure applying assembly 28 includes the shaft 36 which has an outer end 58 that is threaded and receives thereon a metal washer 60 and nut 62. Pressure on faces 40, 42 and 44,46 (washer 38) and on faces 50, 51 and 52, 53 (washer 48) is established by a helical compression spring 64 on the shaft 36 between metal washer 60 and a side surface 66 of first plug member 30. Washer 60 provides a movable compressional surface 68 as nut 62 is turned along threaded outer end 58 of shaft 36. As decribed further below, spring 64 rotates with first tube 12, thereby eliminating wear on inner surface 68 of washer 60 and surface 66 of first plug member 30, against which ends 70 and 72 of spring 64 bear.

Figure 3:
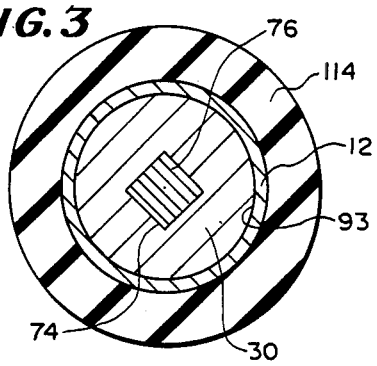
FIG. 3 is a sectional view of a plug member in the first tube of the exercising device and is taken along line 3—3 of FIG. 2.
Figure 4:
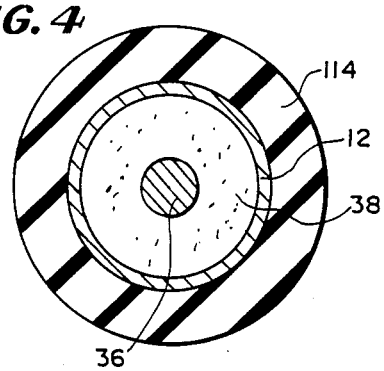
FIG. 4 is a sectional view of an elastomeric washer situated between plug members in the first and second tube and is taken along line 4—4 of FIG. 2.

According to the teachings of the present invention, the first plug member 30 has a passageway 74 therethrough having a spline cross-section, e.g., a squared cross-section, as shown in FIG. 3. A middle portion of the shaft 36 has a mating spline formation 76 which permits sliding movement of shaft 36 relative to the first plug member 30, but not rotational movement relative to the first plug member 30. Instead, the shaft 36 rotates with the first plug member 30 when the first tube 12 is rotated. As a result, chafing or wear on the surface 68 of washer 60 and side 66 of first plug member 30 is prevented.

Figure 5:
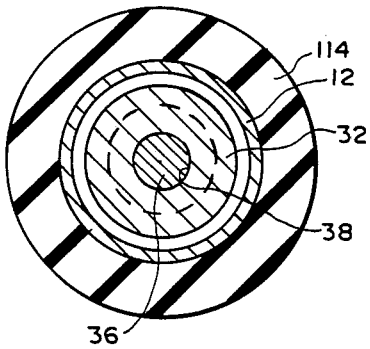
FIG. 5 is a sectional view of the plug member of the first tube and is taken along line 5—5 of FIG. 2.
Figure 6:
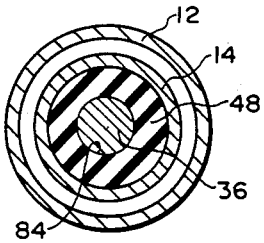
FIG. 6 is a sectional view of an elastomeric washer situated between a plug member in the second tube and the shaft head and is taken along line 6—6 of FIG. 2.
Figure 7:
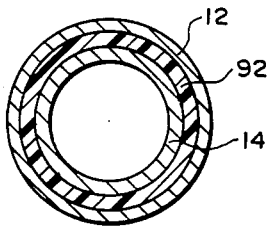
FIG. 7 is a sectional view through the first tube and second tube received therein and is taken along line 7—7 of FIG. 2.

Turning now to the portion of the coupling assembly 24 located in the second tube 14, the second plug member 32 has a cylindrical passageway 80 therethrough, as best shown in FIG. 5, which receives the shaft 36 therein and which permits the second tube 14 to rotate relative to the shaft 36.

As shown, the elastomeric washer 48 has a passageway 84 therethrough to receive the shaft 36 and the washer 48 is located adjacent surface 46 of plug member 32.

Figure 9:
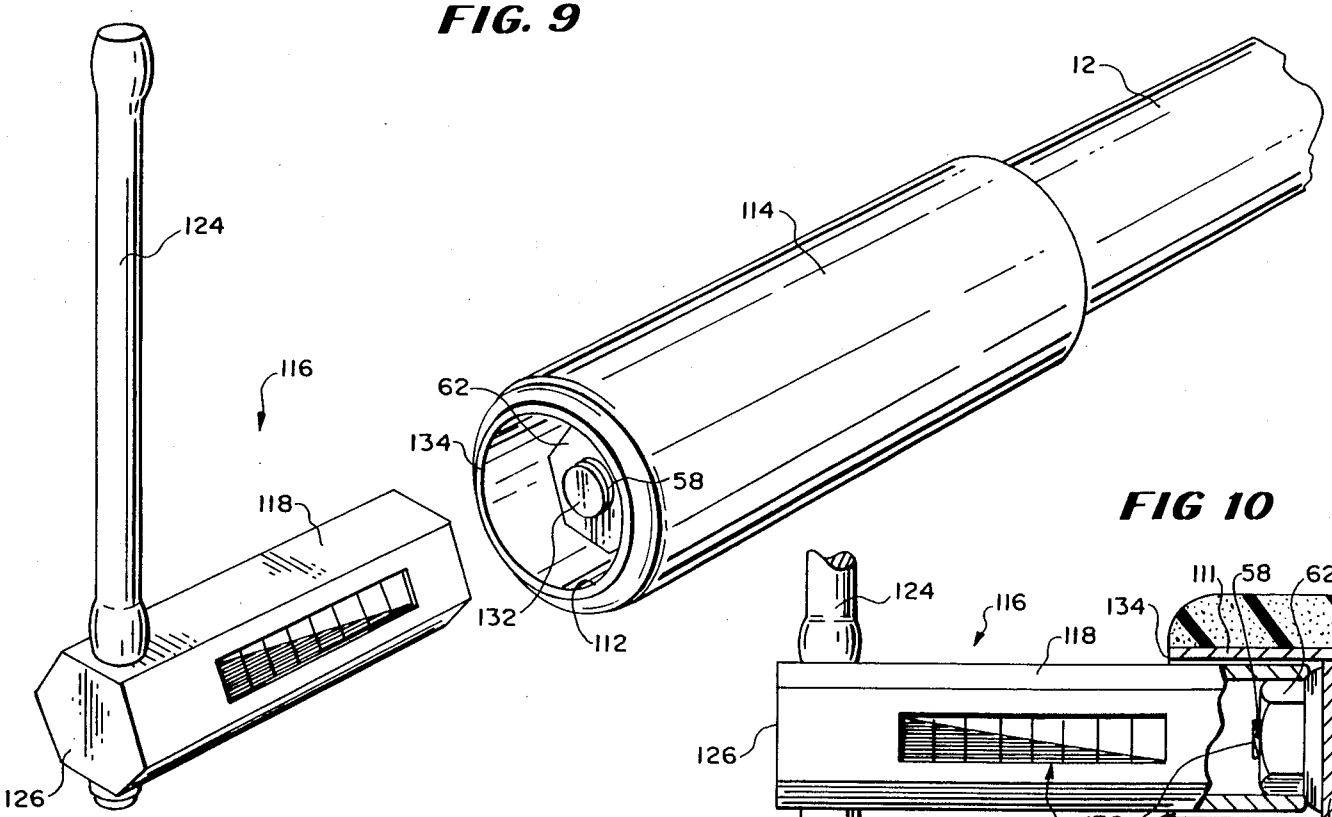
FIG. 9 is a perspective view of the outer end of the first tube and of an adjusting socket wrench for use with the exercising device juxtaposed thereto.

As shown in FIG. 9, the plug members 30 and 32 will rotate in opposite rotational directions, respectively, with the first and second tubes 12 and 14 while elastomeric washer 38 is essentially non-rotational and compressed between the plug members 30 and 32 by pressure applying assembly 28. Further, the washer 48 is essentially non-rotational and compressed between the head 54 and the plug member 32.

Figure 8:
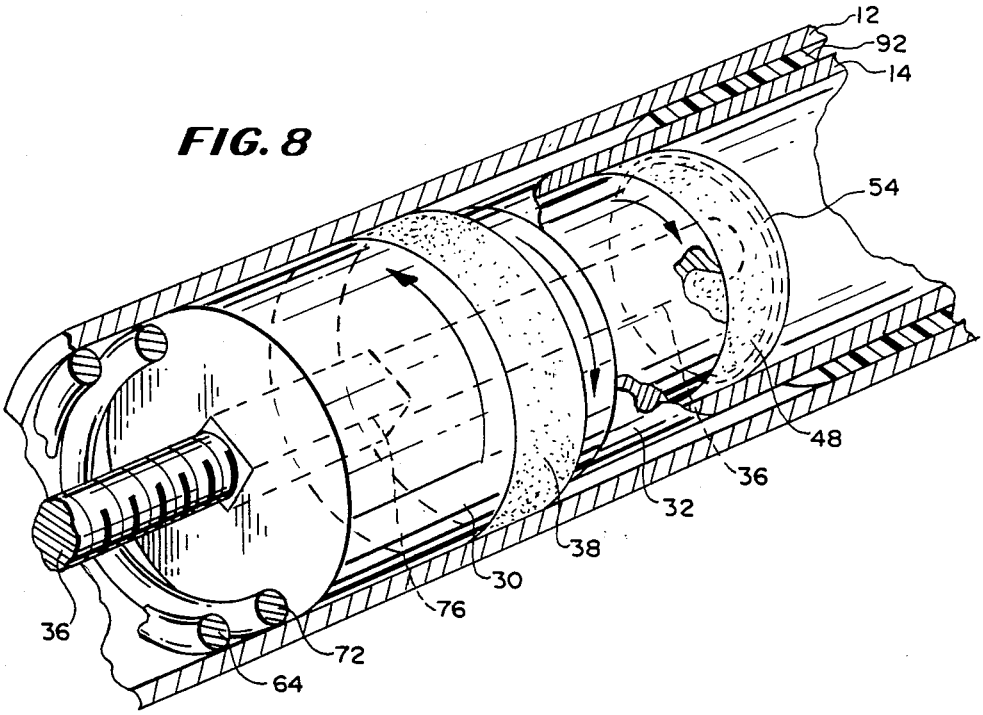
FIG. 8 is a fragmentary prespective view with portions broken away of the plug members and elastomeric washers of a tube coupling assembly of the exercising device of the present invention.

In order to providing sliding bearing and spacing support between tubes 12 and 14 as they are rotated in opposite directions, a sheet of nylon or Teflon TM material 92 is folded around tube 12 and, if desired, glued to tube 12. The nylon sheet 92 has a sufficient thickness and length to provide a spacing function to maintain tube 14 spaced from tube 12. Also, an outer surface 93 of sheet 92 provides a low friction bearing surface on which the inner surface of tube 14 can "ride" or rotate when the tubes 12 and 14 are rotated relative to each other, thereby preventing frictional contact between inner surface 102 of tube 12 and the outer surface 96 of the second tube 14, as shown in FIGS. 2 and 8.

As shown in FIG. 2, an outer end portion 104 of the second tube 14 is flared or tapers outwardly to an outer diameter equal to that of the first tube 12 outwardly of the first tube 12. The outer end of the second tube 14 is closed off with a cap 110 in a spring clip-like manner.

Preferably an outer surface 108 of the outer end portion 104 of the tube 14 and an outer surface 111 of the first tube 12 are both covered with sleeves of an elastomeric material 114 which sleeves provide gripping surfaces 16 and 18.

In order to provide access to the nut 62, the end 112 of the first tube 12 is open and is sized to receive a wrench 116 designed for use with the device 10, as best shown in FIG. 9. The wrench 116 comprises a hollow tubular member 118 having a hexagonal cross section sized and configured to be received over and in engagement with the nut 62. The wrench 116 has a handle 124 extending radially outwardly from an outer end 126 of the tubular member 118.

Figure 10:
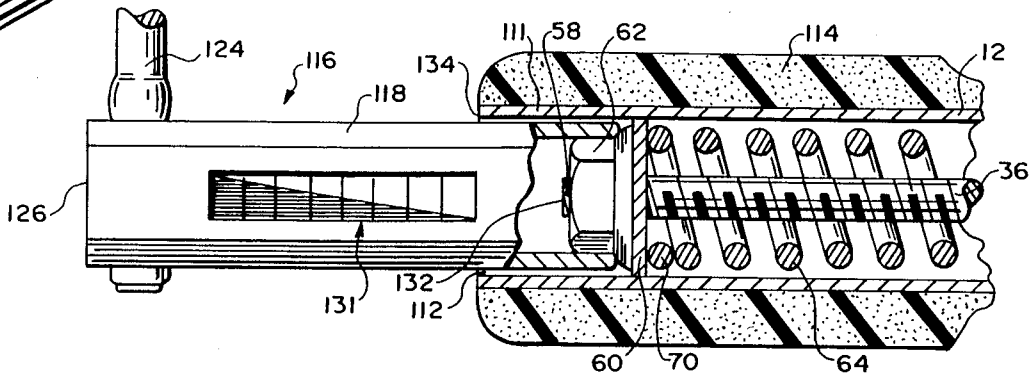
FIG. 10 is a fragmentary sectional view with portions broken away of the outer end of the first tube with the adjusting socket wrench shown positioned within the first tube over a spline or a shaft that extends through and holds together the plug members.

In FIG. 10 the wrench 116 is shown in engagement with the nut 62. Indicia 131 are marked on the outer surface of the tubular member 118 for indicating the pressure applied by the spring 64 against the plug and washer surfaces 40, 42 and 44, 46.

More specifically the indicia 131 are exposed beyond the end 112 of the first tube 12 to indicate the relative amount of pressure being applied against axial surfaces 40, 42 and 44, 46 of plug members 30 and 32 respectively, by the spring 64. In other words, the pressure applied by spring 64 is a direct function of the relative distance of the nut 62 from the end 112.

For example, when the nut 62 is located at the tip 132 of the shaft end 58, the tubular member 118 of wrench 116 can only be inserted a short distance into the open end 112 of tube 14 where it abuts washer 60. The indicia 131 corresponding to this distance of insertion of tubular member 118 of wrench 116 will indicate a relatively minimal degree of applied pressure.

Then, when the wrench 116 is turned by applying pressure on handle 126 to move the nut 62 inwardly along the shank 58 from the tip 132 toward a position of maximum spring pressure against the washers 38 and 48 by urging washer 60 toward the plug member 30 and compressing spring 64 therebetween to increase applied pressure of surfaces 40, 42 and 44, 46 of plug members 30 and 32 against washers 38 and 48 respectively. As this movement progresses, the tubular member 118 moves inwardly and the portions of the indicia 131 are hidden from view in increments within the end 112 of the first tube 12.

In other words, when the tubular member 118 of the wrench 116 is positioned over the nut 62 when the nut 62 is at the tip 132 of the sahft end 58, the indicia 131 on the side of the tubular member 118 are at a position adjacent an edge 134 of outer end 112 of the tube 12 to indicate a minimum spring pressure. Then, as the nut 62 is turned by the tubular member 118 to move along the shaft end 58, the indicia 132 increments will become hidden from view within the end 112 of the first tube 12 and the increments of indicia exposed outwardly of the end 112 indicate an increase in spring pressure.

As the nut 62 is moved to a position as close as possible to the plug member 30, the indicia 131 on tubular member 118 will become completely hidden from view within the open end 112 of the first tube 12 to indicate maximum spring pressure.

From the foregoing description it will be apparent that the exercise device 10 including the wrench 116 of the present invention provide a number of advantages, some of which have been described above and others of which are inherent in the invention. Accordingly, the scope of the invention is only to be limited as necessitated by the accompanying claims.

I claim:

1. A hand manipulatable exercise device comprising first and second hollow tubes each having a hand grippable outer surface, said second tube being telescopically received in said first tube, and means within said tubes for coupling said tubes together in a manner permitting relative rotation therebetween against an adjustable frictional resistance to rotation thereof, said coupling means including means for establishing at least two frictional surface, means located within and rotatable with said first tube for adjusting pressure on said surfaces, said coupling means including a first plug member fixed within said first tube, a second plug member fixed to the inner end of said second tube, means for urging said plug members toward each other including a shaft, said first plug member further having a bore therethrough having a splined cross-section, and said shaft having a spline formation on at least a middle portion thereof arranged to be received within said spline cross-section bore whereby said shaft is slidable in said spline cross-section bore and rotates with said first tube.

2. The device of claim 1 wherein said shaft extends through said plug members and which has first stop means on a portion of said shaft within said first tube and second stop means on the end of said shaft within said second tube adjacent said second plug member.

3. The device of claim 2 wherein said second stop means include a head at the end of said shaft adjacent said second plug member.

4. The device of claim 2 wherein said second plug member has a bore therethrough and said shaft is slidably and rotatably received through said bore.

5. The device of claim 1 wherein at least one of said frictional surfaces is defined by an axial face of one of said plug members facing toward said other plug member.

6. The device of claim 1 wherein said means for establishing frictional surfaces include an elastomeric washer situated between said plug members such that two pairs of abutting axially facing frictional surfaces are provided, one surface of each pair of surfaces being defined on each side of said washer and the other surface being defined by an adjacent axially facing surface on one of said plug members.

7. The device of claim 1 wherein said pressure adjusting means and said urging means include said shaft, said shaft having a threaded end, a nut and washer on said threaded end and a spring on said shaft between said washer and said first plug member, said middle portion of said shaft extending through said first plug member and the other end of said shaft extending through said second plug member and having stop means engaging said second plug member.

8. The device of claim 5 wherein said means for establishing frictional surfaces includes an elastomeric washer situated between said plug members such that two pair of abutting axially facing frictional surfaces are provided, one surface of each pair of surfaces being defined on each side of said washer and the other surface being defined by an adjacent axially facing surface on one of said plug members.

9. The device of claim 8 wherein said pressure adjusting means and said urging means include said shaft, said shaft having a threaded end, a nut and a washer on said threaded end and a spring on said shaft between said washer and said first plug member, and said middle portion of said shaft extending through said first plug member and the other end of said shaft extending through said second plug member and having stop means engaging said second plug member.

10. The device of claim 1 including a sheet of low friction material mounted between said second tube and said first tube, said sheet of material providing a sliding bearing function and a spacing function between said tubes.

11. The device of claim 10 wherein said sheet is folded around and adhered to said second tube.

12. The device of claim 10 wherein said sheet of material is made of nylon.

13. The device of claim 10 wherein said sheet of material is made of polytetrafluoroethylene.

14. The device of claim 1 wherein said second tube is flared outwardly to an outer end portion thereof which has the same outer diameter as the outer diameter of said first tube.

15. The device of claim 14 wherein said first tube and said second tube each have an elastomeric foam grippable sleeve on at least a portion of the outer surface thereof to define said hand grippable outer surfaces.

16. For use with an exercise device as defined in claim 7, a wrench comprising a hollow hexagonal tubular member sized and configured to be received over and in engagement with said nut and having an outer surface sized to fit within said first tube, and a handle extending radially outwardly from the other end of said hollow hexagonal tubular member.

17. The wrench of claim 16 having means for indicating the pressure applied as determined by the distance said nut has been threaded onto said threaded end of said shaft against said washer bearing against said spring.

18. The device of claim 6 wherein said means for establishing frictional surfaces includes a second elastomeric washer situated between said second plug member and head of said shaft in said second tube such that two additional pairs of frictional surfaces are provided.

* * * * *